US006220123B1

(12) United States Patent
Chen

(10) Patent No.: US 6,220,123 B1
(45) Date of Patent: Apr. 24, 2001

(54) STRUCTURE OF A RATCHET WRENCH

(76) Inventor: Yu-Tang Chen, PO Box 82-144, Taipei (TW)

( * ) Notice: Subject to any disclaimer, the term of this patent is extended or adjusted under 35 U.S.C. 154(b) by 0 days.

(21) Appl. No.: 09/450,448

(22) Filed: Nov. 30, 1999

(51) Int. Cl.[7] ..... B25B 13/46

(52) U.S. Cl. ..... 81/63.2; 81/63.1; 81/63; 81/61

(58) Field of Search ..... 81/63.2, 63.1, 81/63, 62, 61, 60

(56) References Cited

U.S. PATENT DOCUMENTS 4,336,728 * 6/1982 Deibert .
5,477,757 * 12/1995 Maresh .
5,913,954 * 6/1999 Arnold et al. .
5,957,009 * 9/1999 McCann .
6,044,731 * 4/2000 Hsieh .

* cited by examiner

*Primary Examiner*—Joseph J. Hail, III
*Assistant Examiner*—Willie Berry, Jr.
(74) *Attorney, Agent, or Firm*—A & J

(57) ABSTRACT

The present invention relates to the structure of a ratchet wrench, and in particular, to a ratchet wrench which can provides high torque engagement in application, wherein a ratchet wheel is inserted into a circular opening on the wrench head of a common ratchet wrench, and a cavity is provided to the circular opening adjacent to one side of the rod body of the wrench for mounting a restrictive teeth structure, the end terminal of the cavity is provided with a ball hole to contain a spring and a steel ball, and the restrictive teeth structure is urged by the steel ball, thereby the high torque movement of the ratchet wheel is controlled.

3 Claims, 24 Drawing Sheets

STRUCTURE OF A RATCHET WRENCH

BACKGROUND OF THE INVENTION a) Technical Field of the Invention

The present invention relates to a wrench structure, and in particular, to a ratchet wrench capable of providing high torque movement.

b) Description of the Prior Art

As shown in FIG. 1, a common conventional wrench 10 has a plurality of engaging notches 11 formed as one unit with the wrench 10 and the notches 11 moves together with the wrench 10 to rotate a nut 12. When the wrench 10 is rotated to a certain degree, as a result of restriction by object around the wrench 10, the wrench 10 has to be lifted up and placed at the original position and then repeat the process in order to rotate the nut 12. As a result of repeating engagement and disengagement of the wrench 10 with the nut 12, the notch 11 of the wench 10 is often dislocated in the process of tightening or loosening of the nut 12.

FIG. 2 is another prior art wrench 10 having a bent structure to provide convenient holding of the handle of the wrench 10 by a user. However, this type of wrench 10 has the drawback as that of FIG. 1 and the wrench 10 is often dislocated from the nut 12. Besides, the process of tightening and loosening of nut 12 by using this wrench 10 is slow.

FIGS. 3 and 4 show another types of wrench 20 having a head portion being provided with a circular opening 201 to contain a ratchet wheel 21. A cavity 202 is provided to the circular opening 201, adjacent to the one lateral side of the rod body to contain a restrictive teeth structure 22 and a spring 23. If the ratchet wheel 21 is to rotate clockwise, as the teeth of the ratchet wheel 21 is in engagement with that of the restrictive teeth structure 22, and one side of the restrictive teeth structure 22 is restricted by the wall of the cavity 202, thus, the ratchet wheel 21 cannot rotate clockwise, but the wrench 20 can rotate clockwise to drive the ratchet wheel 21 to rotate the nuts. If the ratchet wheel 21 rotates counterclockwise, as the teeth of the ratchet wheel 21 is in engagement with that of the restrictive teeth structure 22, and one side of the restrictive teeth structure 22 is restricted by the spring 23 and the spring 23 is compressible, thus, ratchet wheel 21 can rotate freely in a counterclockwise direction, and t e eth-skidding is resulted by the teeth of the restrictive teeth structure 22 with that of the ratchet wheel.

The advantage of this wrench 20 is no repeating of engagement and disengagement of the nut 12 with the wrench 20, and the operation of the wrench 20 is faster. However, if a reverse direction of the nut is required, the wrench 20 has to be changed to another face such that the ratchet wheel 21 can be rotated in a reverse direction. In view of the need of reversing the rotation of the wrench 20, it cannot be made into the shape of the wrench 10 as shown in FIG. 2 to provide a bent angle so that the application of the wrench 20 is smooth. The drawback is also found in U.S. Pat. No. 5,636,557.

FIG. 5 is another ratchet wrench 30 having a ratchet wheel 31 provided with a restrictive teeth structure 32. Two sides of the restrictive teeth structure 32 are provided with teeth for the engagement with that of the ratchet wheel 31. The restrictive teeth structure 32 can rotate about a center to a certain degree. The restrictive teeth structure 32 causes the ratchet wheel 31 to produce a single direction rotation. If frequent reverse of direction of rotation is required, the restrictive teeth structure 32 rotates to a certain angle about the center, and at this instance, the teeth at one side of the restrictive teeth structure 32 can engage with the teeth of the ratchet wheel 31 and the restrictive teeth structure 32 causes the ratchet wheel 31 to produce a free rotation. Thus, the rotation of the restrictive teeth structure 32 is used to cause a change of rotation direction. Thus, the wrench having multiple angle shown FIG. 2 can be fabricated. However, this design has other drawback. The engagement of the restrictive teeth structure 32 and the ratchet wheel 31 is depend on a few teeth to provide rotation, if the torque is too great, the restrictive teeth 32 or the engaged teeth of the ratchet wheel 31 may be damaged. U.S. Pat. Nos. 5,884,538, 5,626,062 and 5,782,147 disclose this type of wrench.

U.S. Pat. Nos. 5,533,427 and 5,230,262 provides the advantages that shown in FIGS. 3 and 5. In U.S. Pat. No. 5,533,427, the ratchet wheel 40 of the disclosed wrench 10 is in engagement with the restrictive teeth structure 50 which can resist a larger torque. By using the reverse direction control 60,70, the position of the engagement of the restrictive teeth structure 50 with that of the ratchet wheel 40 is changed so as to change the rotation direction of the ratchet wheel 40. Unlike the wrench in FIG. 3, a reverse of the wrench is required. The wrench 10 can be made into a shape as shown in FIG. 2 to provide smooth use for the user. However, the drawback of such wrench 10 is that the head portion 20 is larger than that shown in FIG. 3 for the reason that the head portion 20 is used to contain the ratchet wheel 40, a directional control 60 and the restrictive teeth structure 50. The design principle of U.S. Pat. No. 5,230,262 is similar to that of U.S. Pat. No. 5,533,427. These two patents disclose wrenches with high torque.

SUMMARY OF THE INVENTION

Accordingly, it is an object of the present invention to prove structure of a ratchet wrench, wherein the ratchet wrench provides a high torque driving.

Further features of the present invention will become apparent from a careful reading of the detailed description provided hereinbelow, with appropriate reference to the accompanying drawings.

DETAILED DESCRIPTION OF THE PRESENT INVENTION

Figure 1:
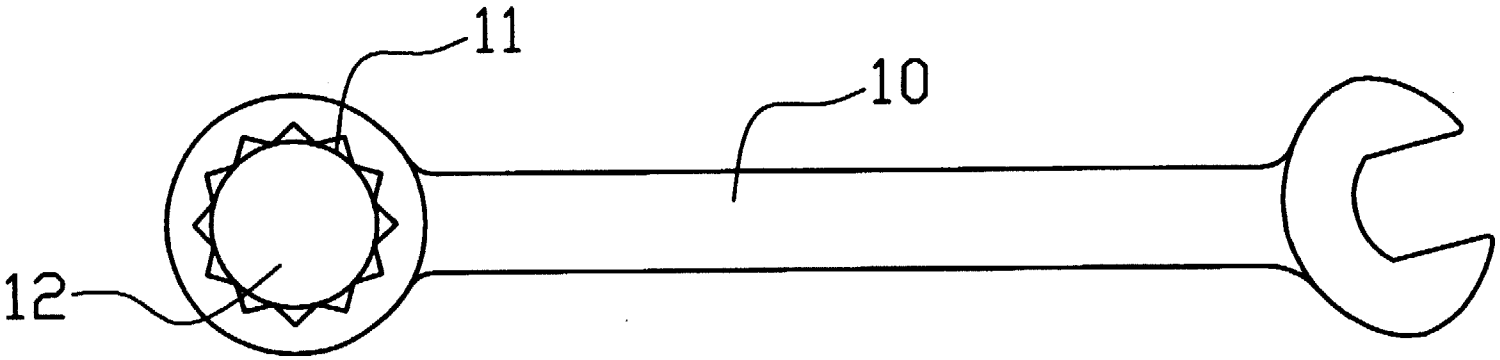
FIG. 1 is a schematic view of a conventional wrench.
Figure 2:
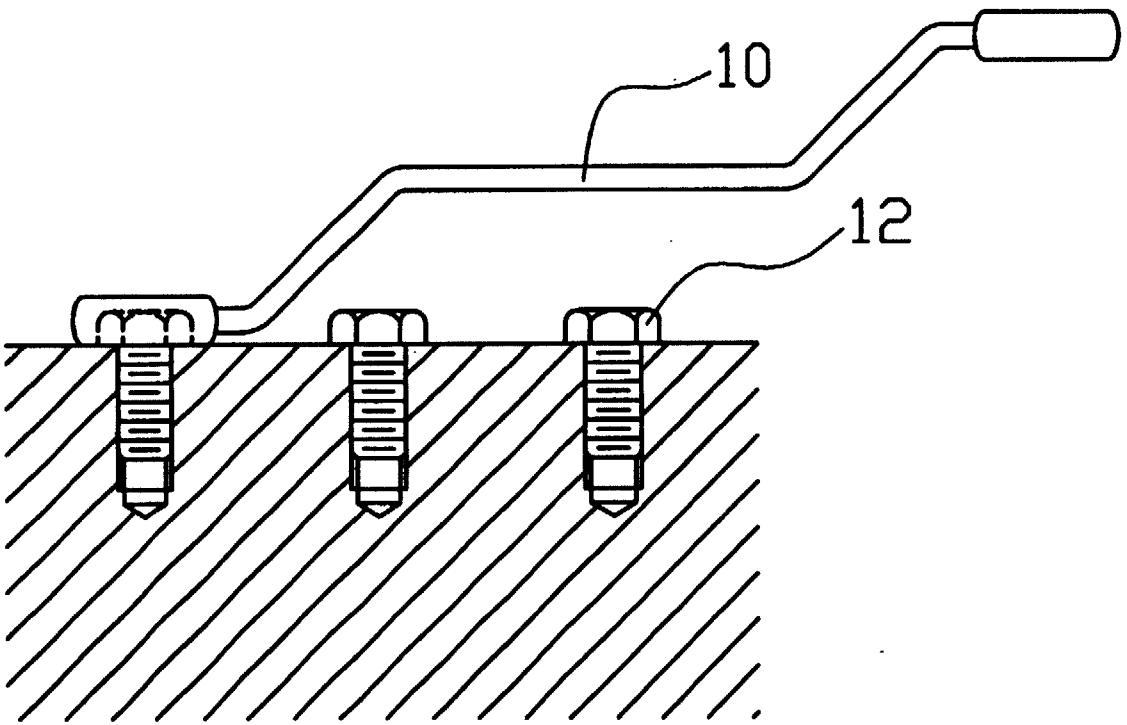
FIG. 2 is a schematic view of a further conventional wrench.
Figure 3:
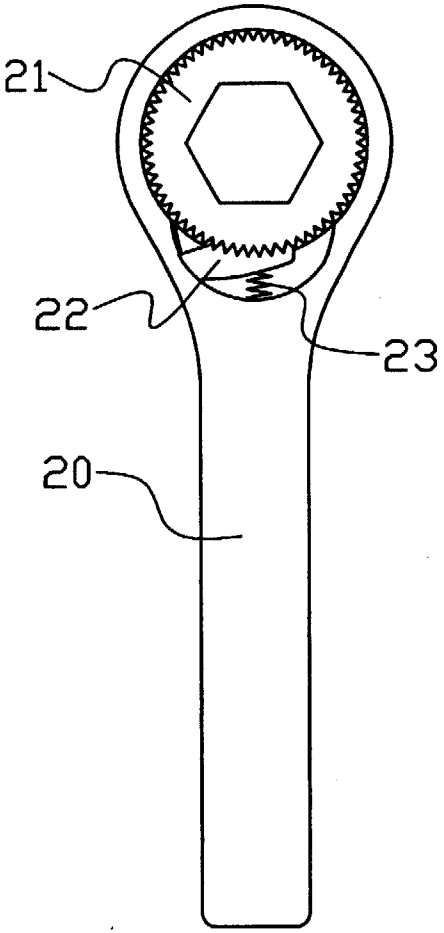
FIG. 3 is a schematic view of a further conventional wrench.
Figure 4:
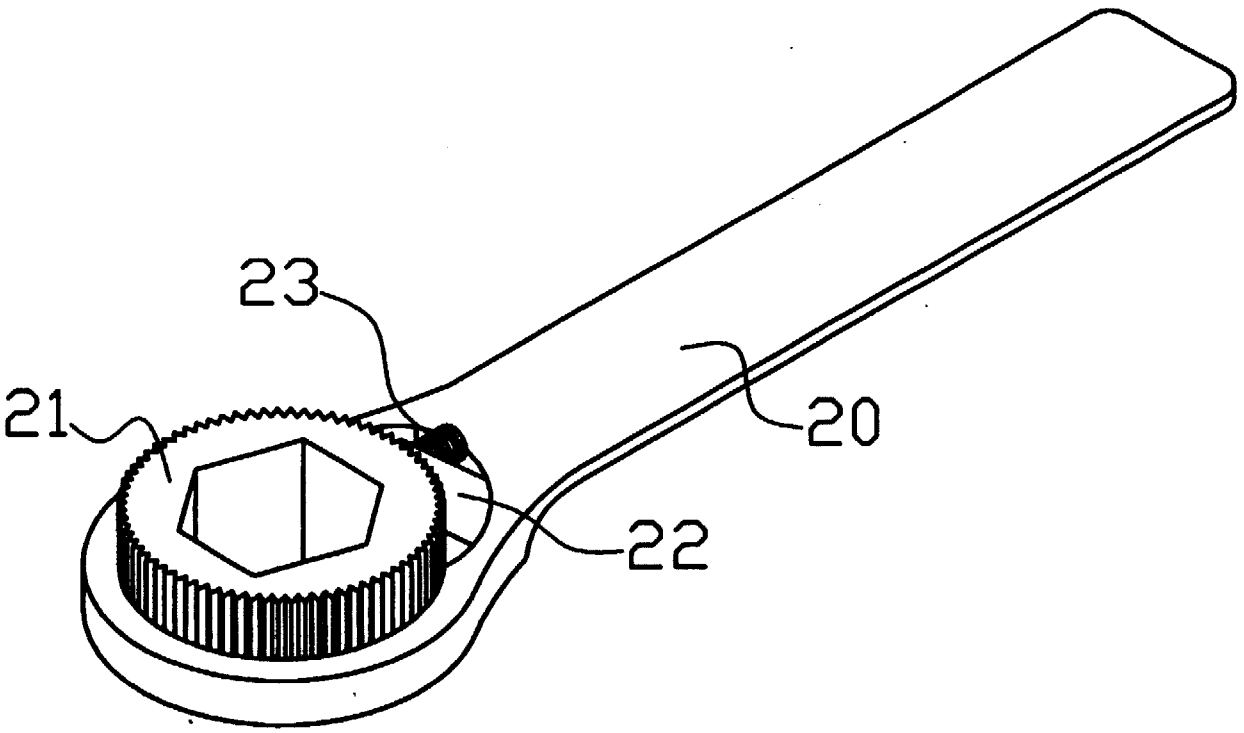
FIG. 4 is a perspective view of the conventional wrench of FIG. 3.
Figure 5:
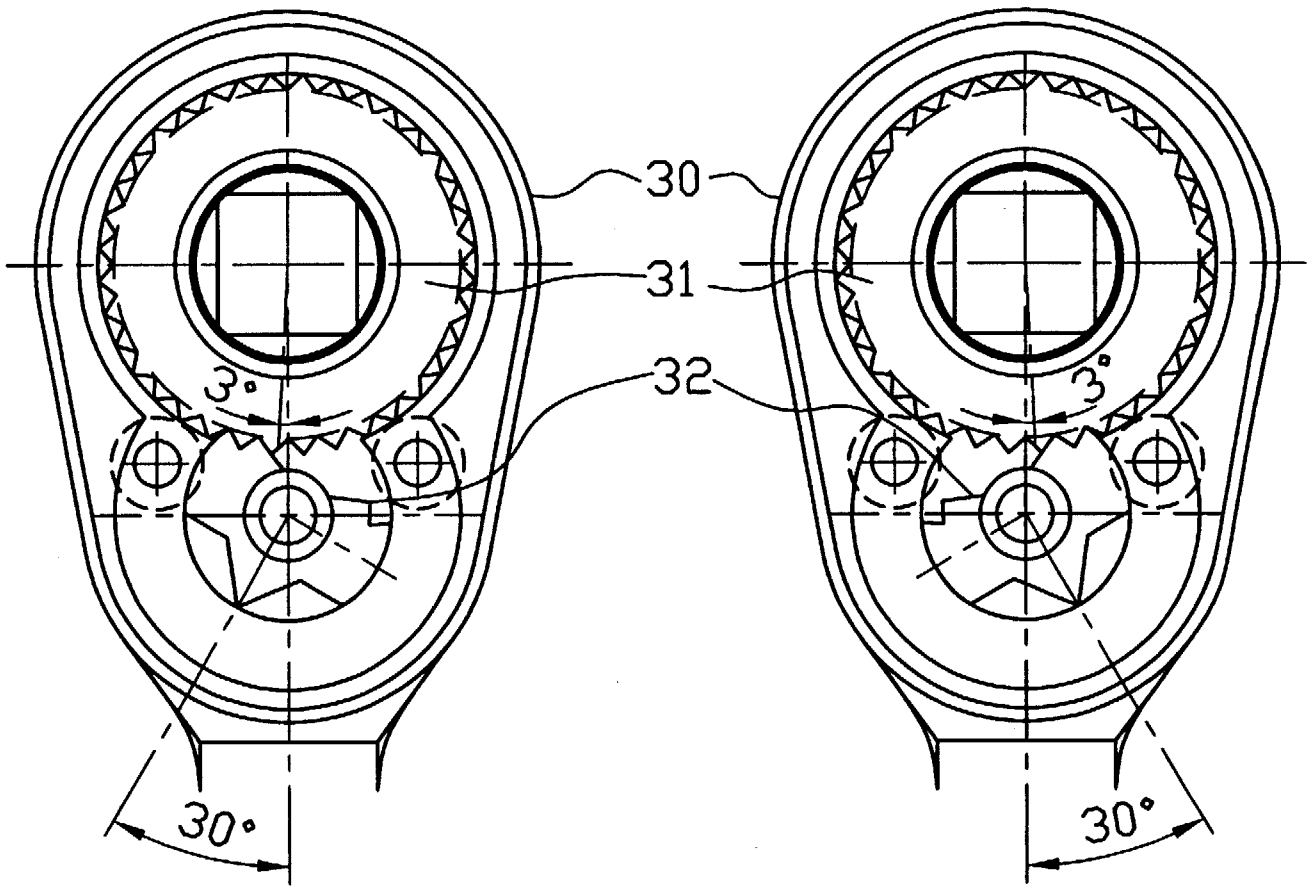
FIG. 5 shows another schematic view of the conventional wrench.
Figure 6:
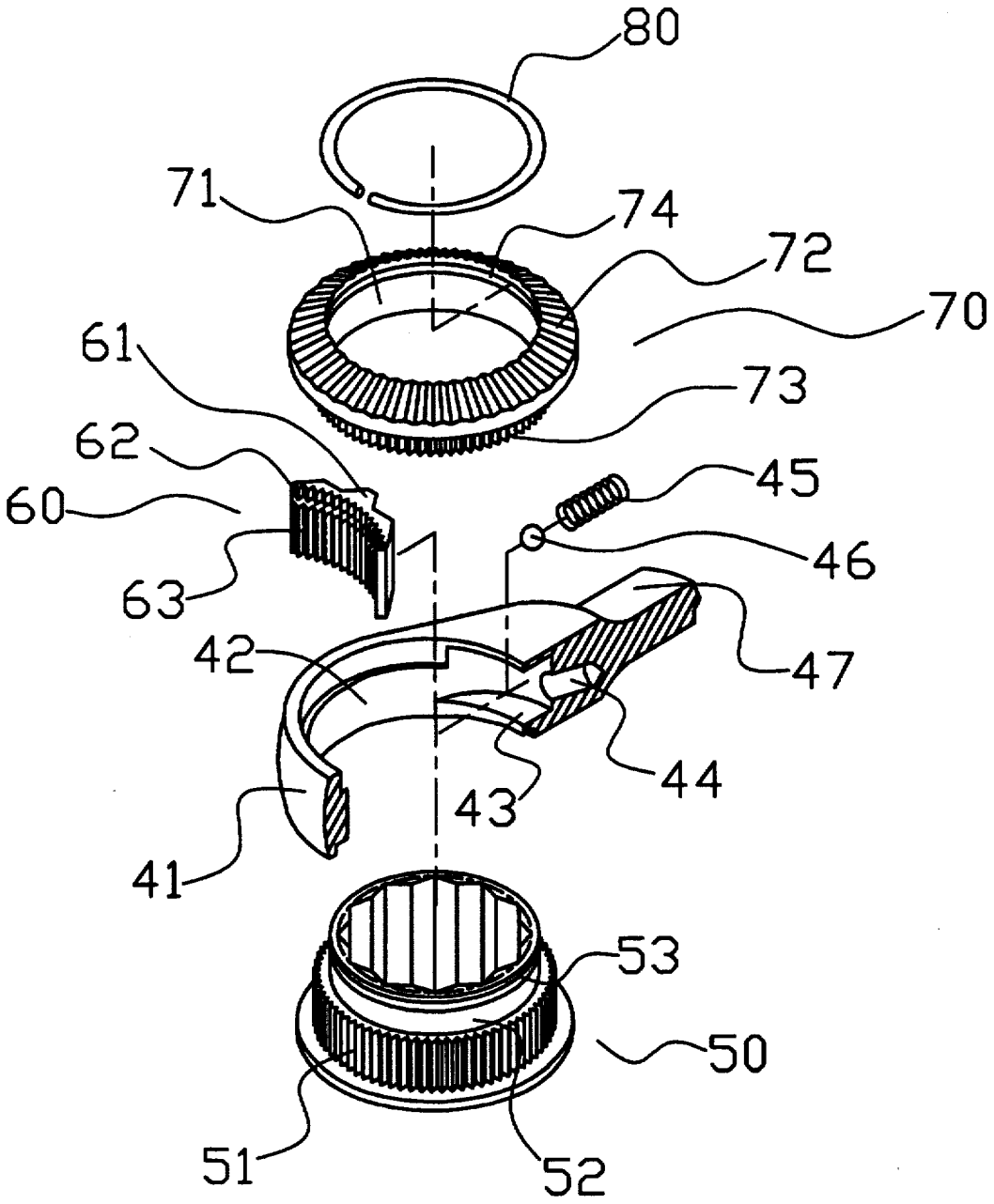
FIG. 6 is a perspective exploded view of the structure of the ratchet wrench of the present invention.
Figure 7:
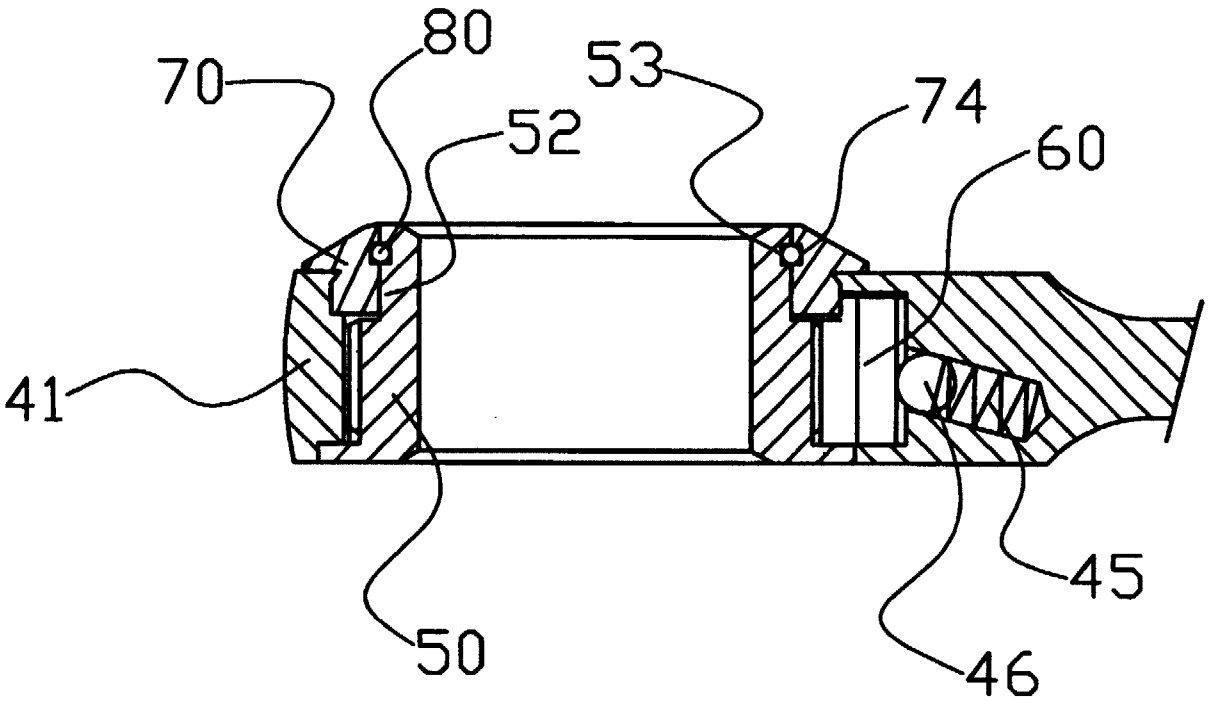
FIG. 7 is a sectional view of the combination of the structure of the ratchet wrench of the present invention.

Referring to FIGS. 6 and 7, there is shown a wrench head 41 having a circular opening 42 to contain a ratchet wheel 50. A rotating disc 70 is used to cover the opening 42. A cavity 43 is provided to the circular opening 42, adjacent to the rod body of the wrench of the present invention to contain a restrictive teeth structure 60. The bottom end of the cavity 43 is provided with a ball hole 44 to contain a spring 45 and a steel ball 46, and the steel ball 46 urges against a protruded block 61 of the restrictive teeth structure 60.

The top end of the ratchet teeth 51 of the ratchet wheel 50 is extended to an extension 52 having a relative small diameter, and the extension 52 is provided with a circular groove 53 for the mounting of a fastening ring 80.

The restrictive teeth structure 60 includes a top ratchet teeth 62 and a bottom ratchet teeth 63, the ratchet teeth 51 of the ratchet wheel 50 corresponds to the bottom ratchet teeth 63 to produce interlinked tightening or free rotation as a result of teeth dislocation. The top ratchet teeth 62 are interlinked with rotational ratchet teeth 73 of the rotating disc 70.

The rotating disc 70 has an inner ring hole 71 which is provided with a circular groove 74 which is corresponding to the circular groove 53 of the ratchet wheel 50 for the mounting of the fastening ring 80. The end face of the rotating disc 70 is provided with an embossed surface 72 and the bottom surface of the embossed surface 72 is provided with the rotational ratchet wheel 73 which is corresponding to the ratchet teeth 62 of the restrictive teeth structure 60 to drive the restrictive teeth structure 60.

Figure 8:
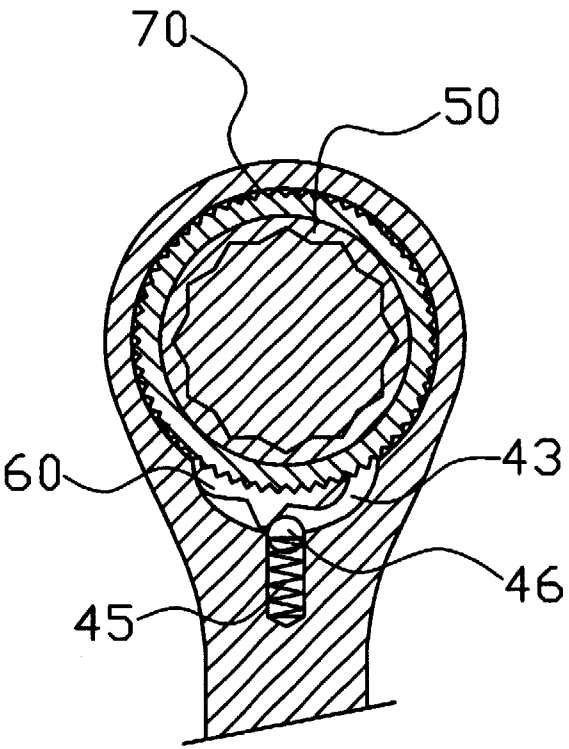

In accordance with the present invention, the pushing force of the spring 45 is used to push the steel ball 46 to urge the side of the protruded block 61 of the restrictive teeth structure 60 such that the restrictive teeth structure 60 holds the ratchet wheel 50 and leans against the wall surface of the cavity 43. As shown in FIG. 8, the ratchet wheel 50 rotates in a clockwise direction and the restrictive teeth structure 60 is driven to drive accordingly.

As the restrictive teeth structure 60 is restricted by the wall of the cavity 43, if the exerted force becomes larger and larger, the urging force also becomes larger to produce high torque rotational function. When the ratchet wheel 50 rotates in a counter-clockwise direction, the restrictive teeth structure 60 causes a t e eth-skidding phenomenon with the ratchet wrench and the ratchet wheel 50 rotates freely. The important characteristics of the present invention is to change the urging position of the restrictive teeth structure 60 and change the direction of free rotation of the ratchet wheel 50.

Figure 10:
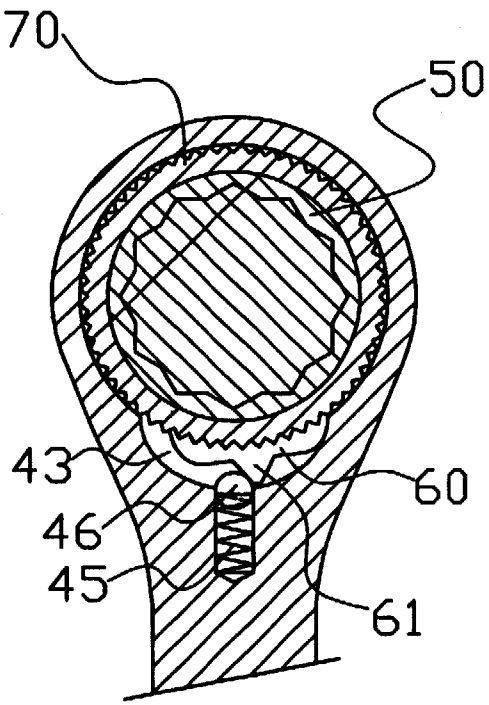
FIGS. 8 to 10 are schematic views illustrating the reverse displacement of the restrictive gear.
Figure 9:
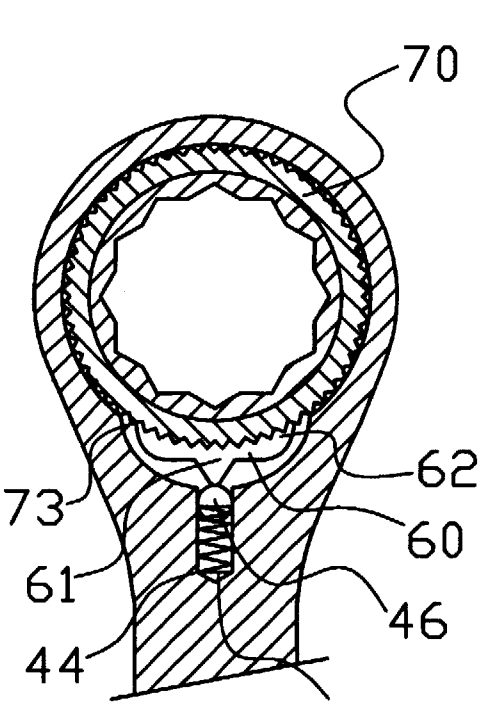

Referring to FIGS. 9 and 10, the rotation of the rotating disc 70 drives the ratchet teeth 73 to rotate the ratchet teeth 62 of the restrictive teeth structure 60 and the protruded block 61 urges the steel ball 46, and the spring 45 to move toward the ball hole 44 until the displacement of the protruded block 61, and the steel ball 46 urges another side of the protruded block 61, and the restrictive teeth structure 60 and the ratchet wheel 50 are urged to contact with the other wall of the cavity 43. Thus, the direction of the restrictive teeth structure 60 is changed, and the ratchet wheel 50 can perform a tightening operation of another direction of rotation or another free rotating operation, and the direction of rotation is totally controlled by the direct driving of the rotating disc 70. Accordingly, the present invention provides an operation of dual direction to a bolt 21. In addition, the rod body 47 of the ratchet wrench can be bent to avoid the blockage of the bolt 21. Thus, the present invention provides a rapid and convenient operation and a larger torque.

Figure 11:
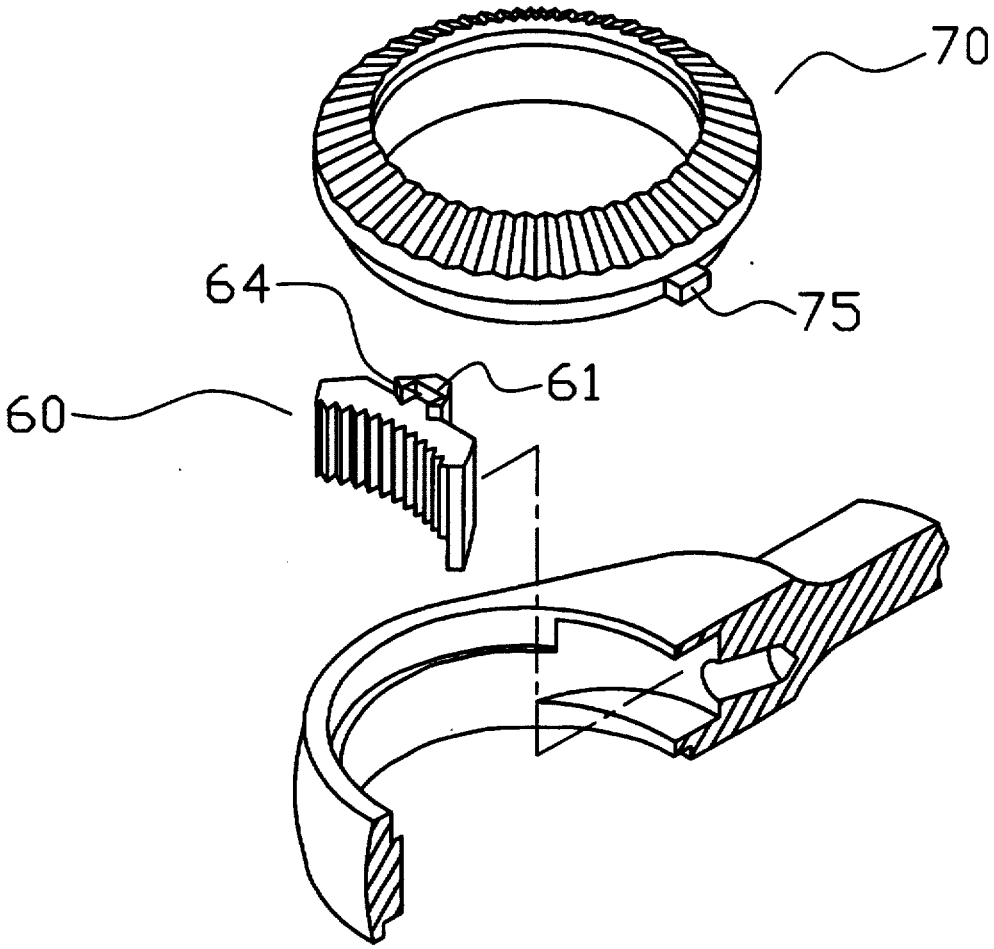
FIGS. 11 and 12 are perspective view of a second preferred embodiment of the present invention.
Figure 12:
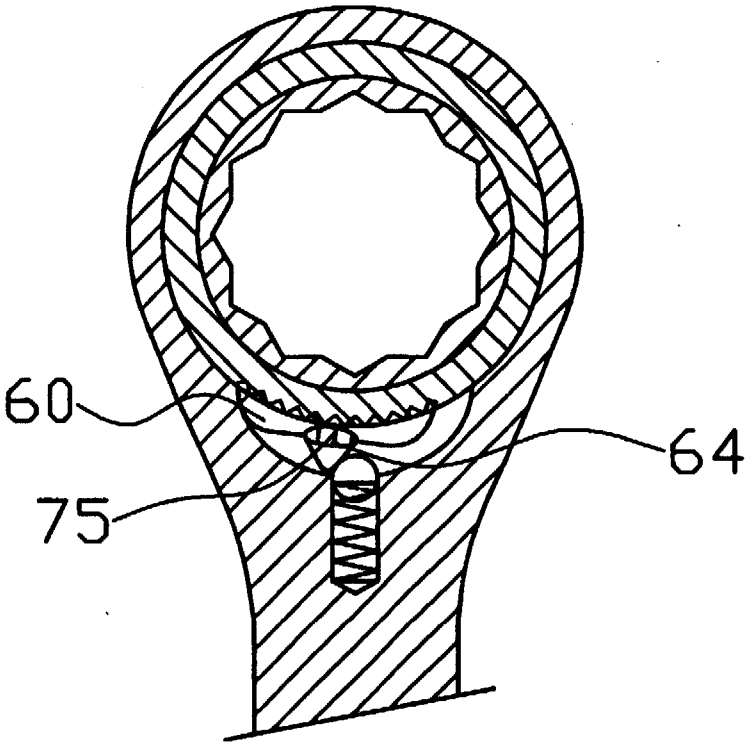

Referring to FIGS. 11 and 12, there is shown a second preferred embodiment for the directional control. In accordance with the preferred embodiment, the change of directional control of the ratchet teeth is changed by the control of the interlinking block 75. The interlinking block 75 is provided at the lateral side of the rotating disc 70, and the relative position of restrictive teeth structure 60 is provided with a recess 64. The size of the recess 64 is larger than that of the interlinking block 75 in order to avoid the restrictive teeth structure 60 being blocked by the interlinking block 75 when the teeth-skidding phenomena is occurred. The interlinking block 75 riggers the restrictive teeth structure 60 to produce a displacement and the steel ball 46 urges the other side of the protruded block 61.

Figure 13:
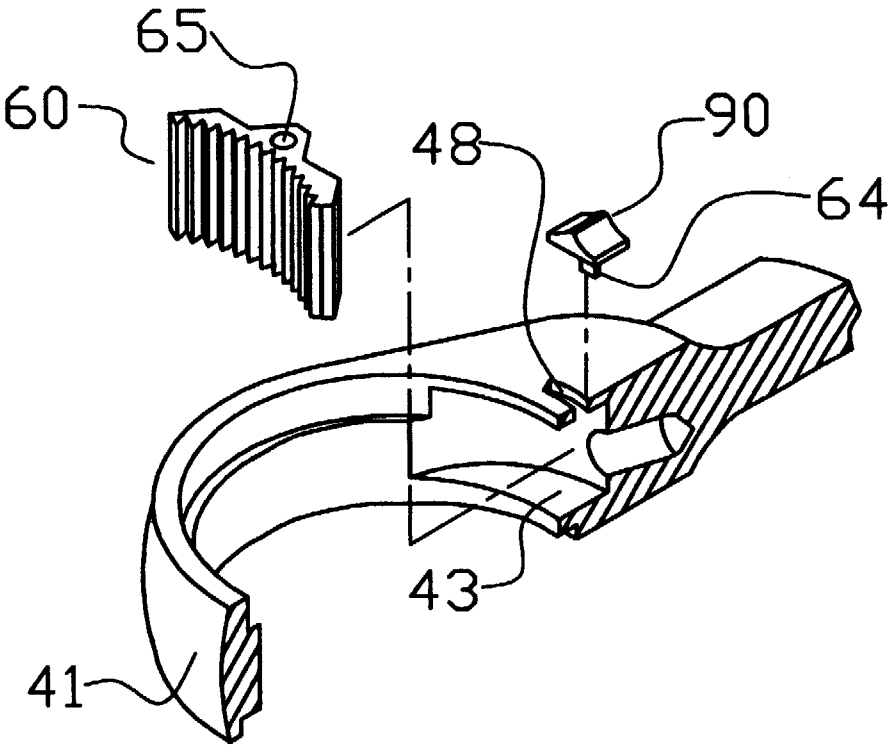
FIGS. 13 and 14 are perspective views of a third preferred embodiment of the present invention.
Figure 14:
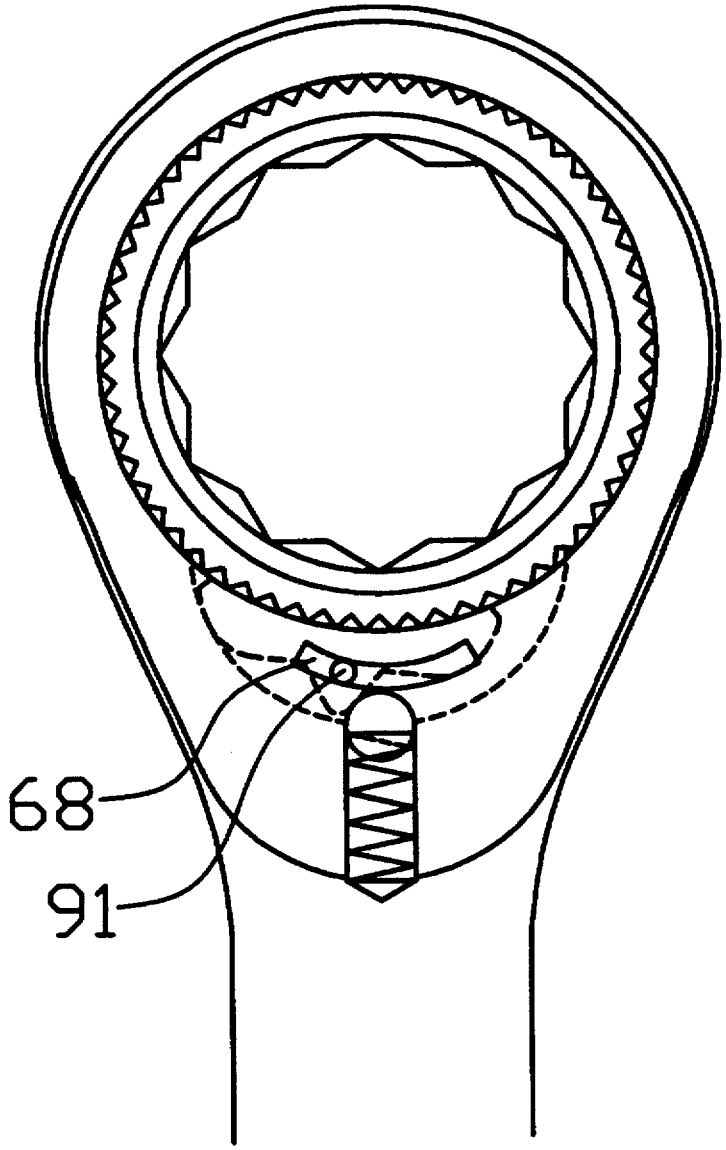

Referring to FIGS. 13 and 14, there is shown a third preferred embodiment for the directional control. A depression 65 is provided to the restrictive teeth structure 60 and a slot 48 is provided to the cavity 43. The extended rod 91 of the push button 90 passes through the cavity 43 and engages with the depression 65. Thus, the push button 90 can directly interlink with the restrictive teeth structure 60 to cause a change of direction of rotation. This restrictive teeth structure 60 does not require the top ratchet teeth 62 and the bottom ratchet teeth 63, and the rotating disc 70.

Figure 15:
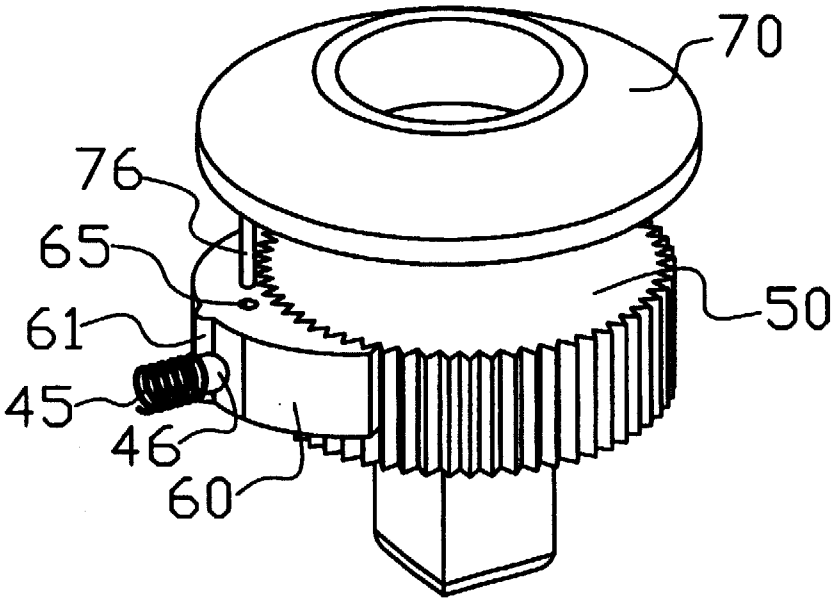
FIG. 15 is a schematic view of a forth preferred embodiment of the present invention.

Referring to FIG. 15, the rotating disc 70 is provided with an interlinked rod 76 which can be inserted into the depression 65. When the rotating disc 70 rotates, the restrictive teeth structure 60 is driven to cause a change of direction of rotation. This restrictive teeth structure 60 design does not require the top 62 and the bottom ratchet teeth 63.

Figure 16:
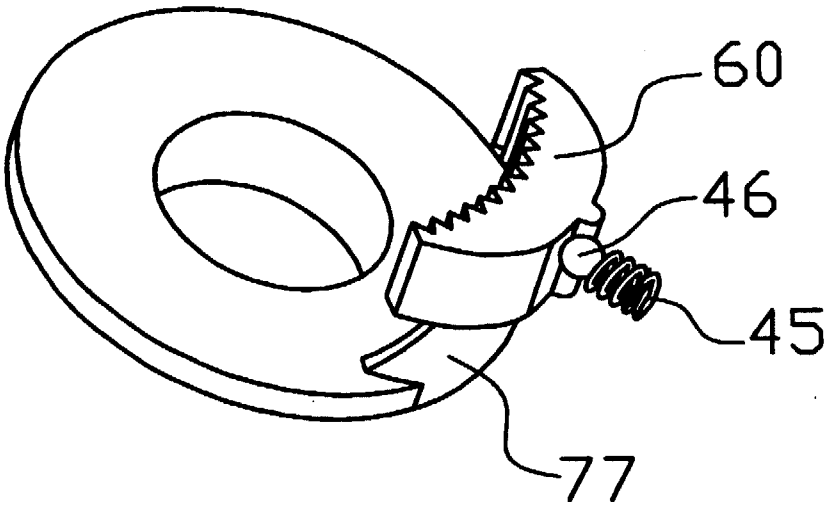
FIG. 16 is a schematic view of a fifth preferred embodiment of the present invention.

Referring to FIG. 16, the rotating disc 70 is provided with an intercommunicated slot 77 having a size which can be inserted into the restrictive teeth structure 60. When the rotating disc 70 rotates, the restrictive teeth structure 60 is driven to produce a change of direction of rotation.

Figure 17:
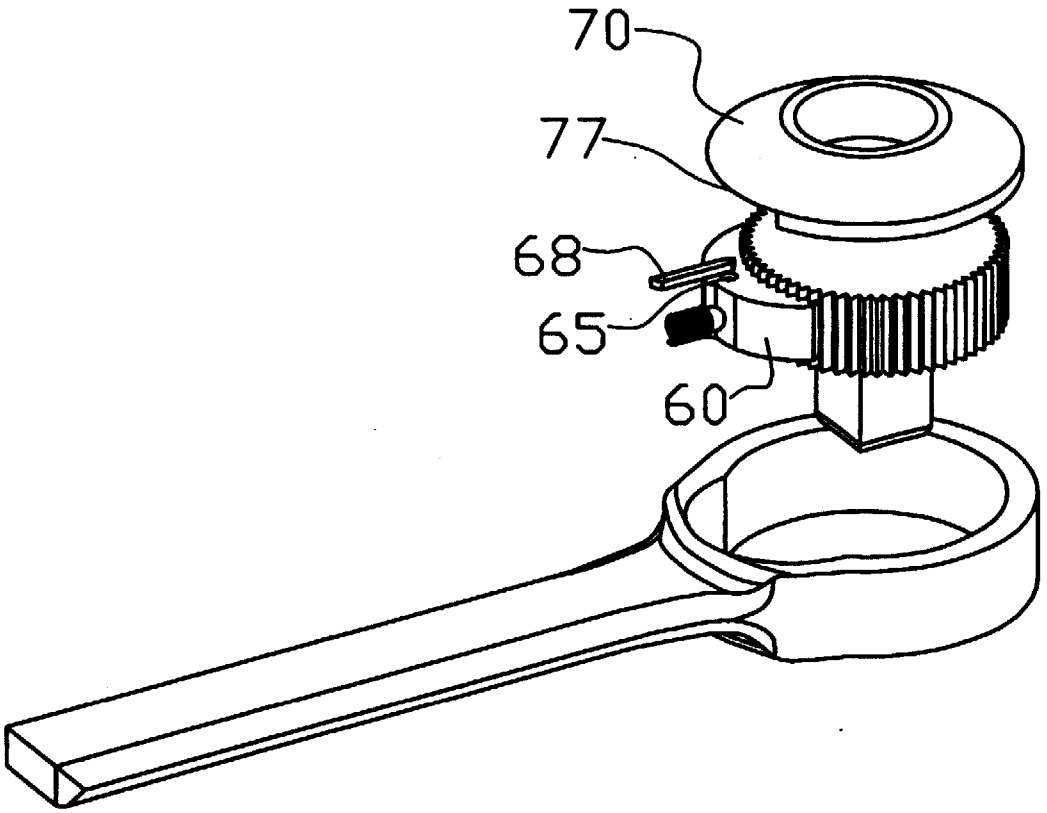
FIG. 17 is a schematic view of a sixth preferred embodiment of the present invention.

Referring to FIG. 17, an insertion rod 68 can be inserted into the depression 65, and the rotating disc 70 is provided with the intercommunicated slot 77. When the insertion rod 68 moves, the insertion rod 68 moves to the other side of the intercommunicated slot 77. Thus, the restrictive teeth structure 60 is driven to cause a change in the direction of rotation.

Figure 18:
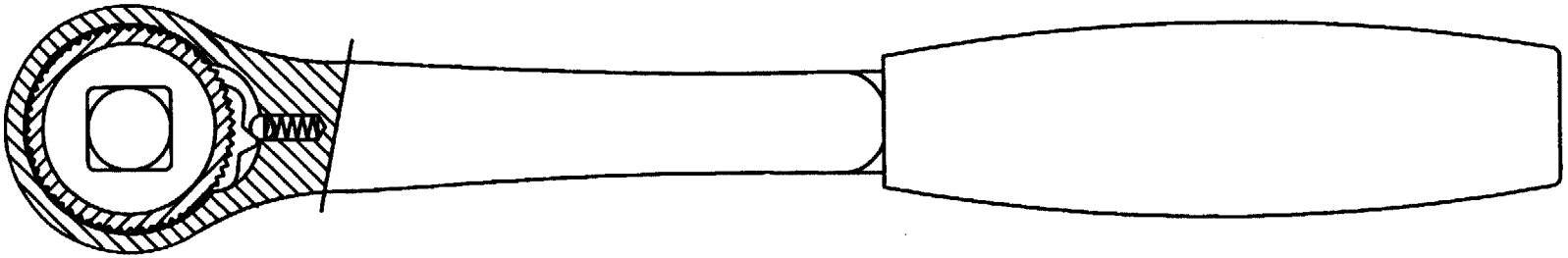
FIG. 18 is a schematic view of the ratchet wrench which can combine with a socket in accordance with the present invention.

FIG. 18 shows the implementation of the present invention on a common ratchet wrench or in combination with the socket of the wrench to provide better effectiveness in application.

Figure 19:
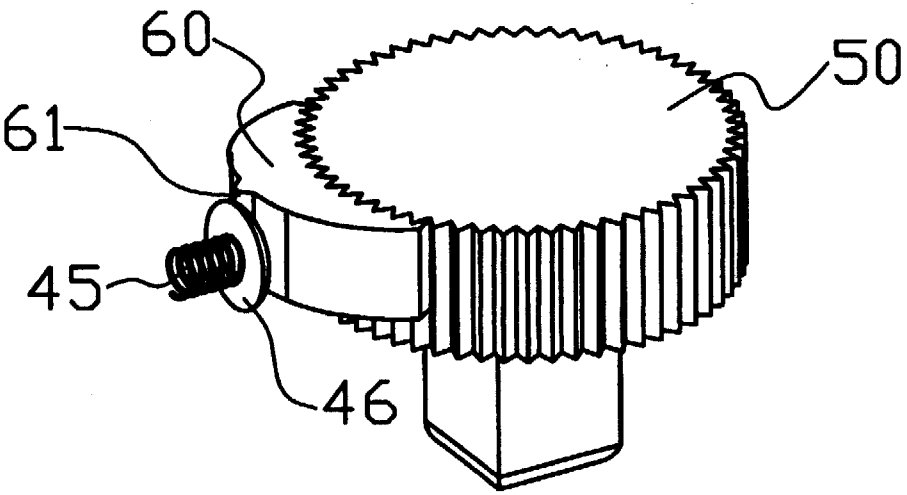
FIGS. 19 and 20 are schematic view showing the ratchet wheel of the present invention.
Figure 20:
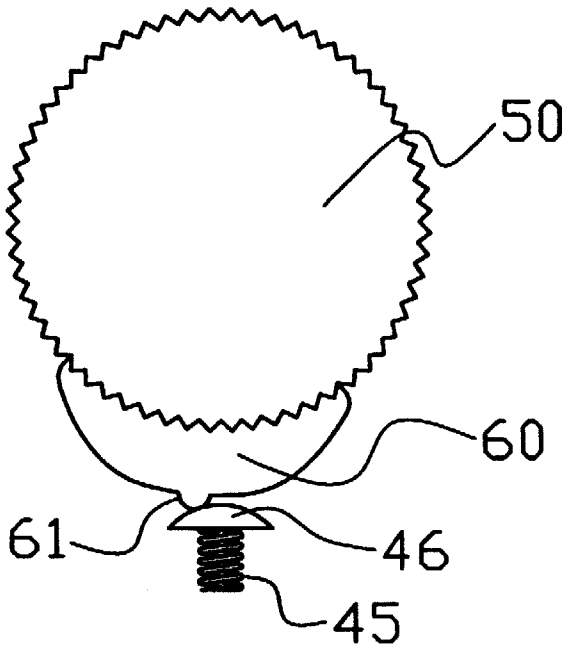
Figure 21:
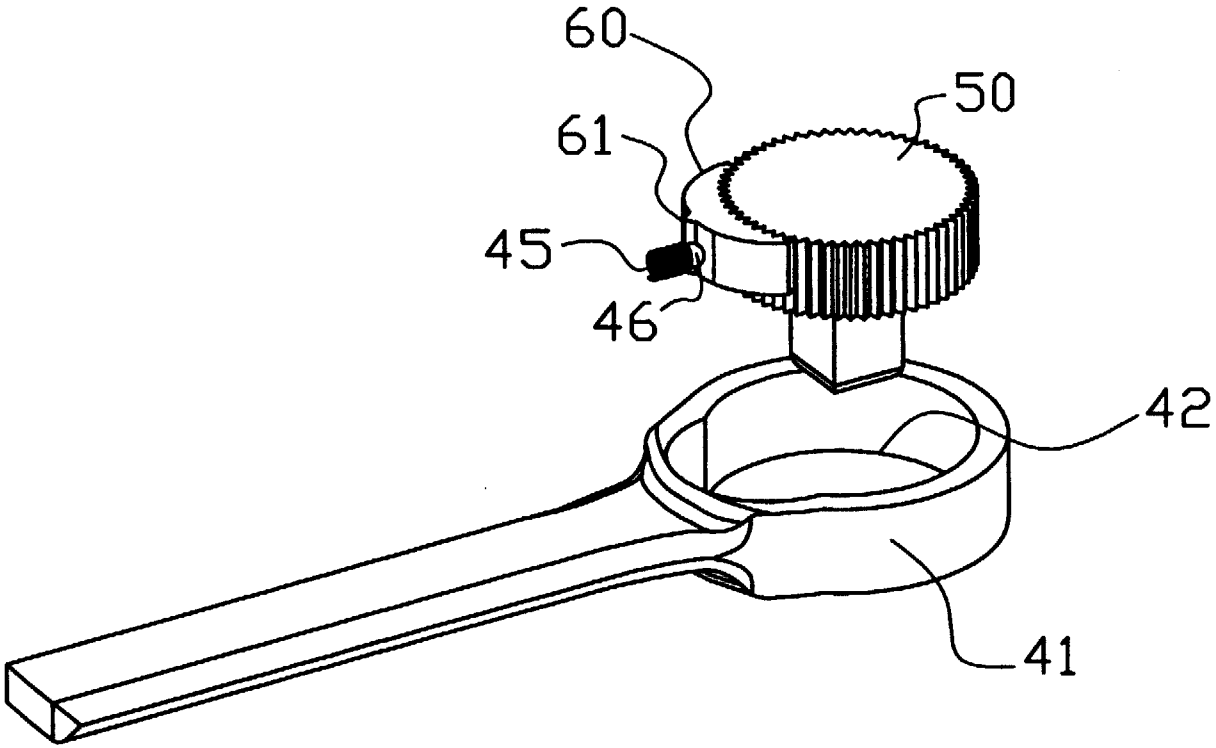
FIG. 21 is a perspective view of the ratchet wrench of the present invention.
Figure 22:
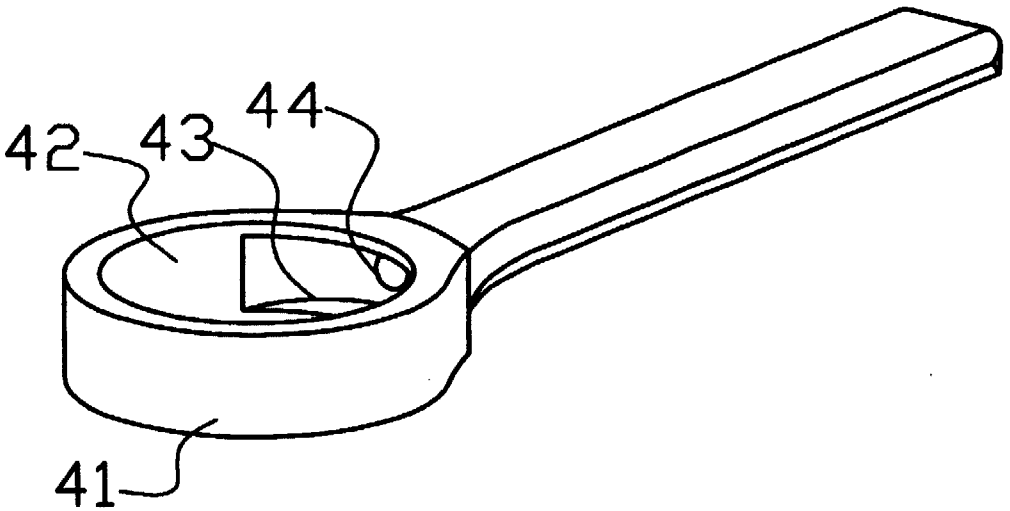
FIG. 22 is a perspective view illustrating the unidirectional wrench head portion of the present invention.
Figure 23:
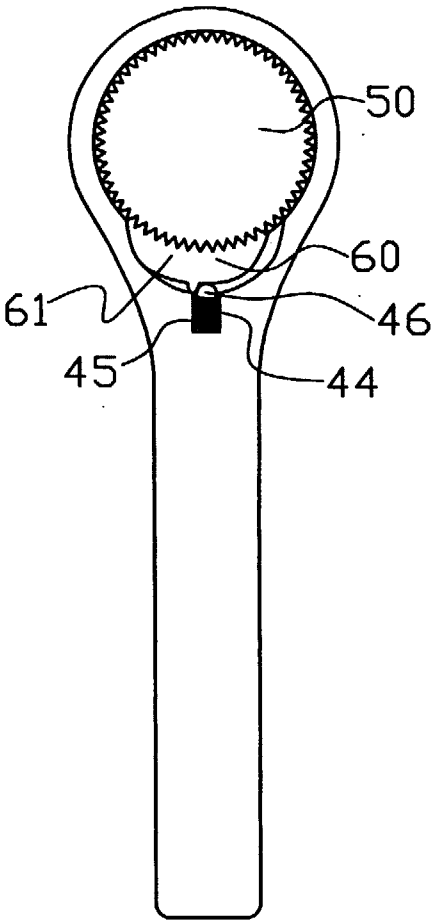
FIG. 23 is a sectional view of the unidirectional movement in accordance with the present invention.
Figure 24:
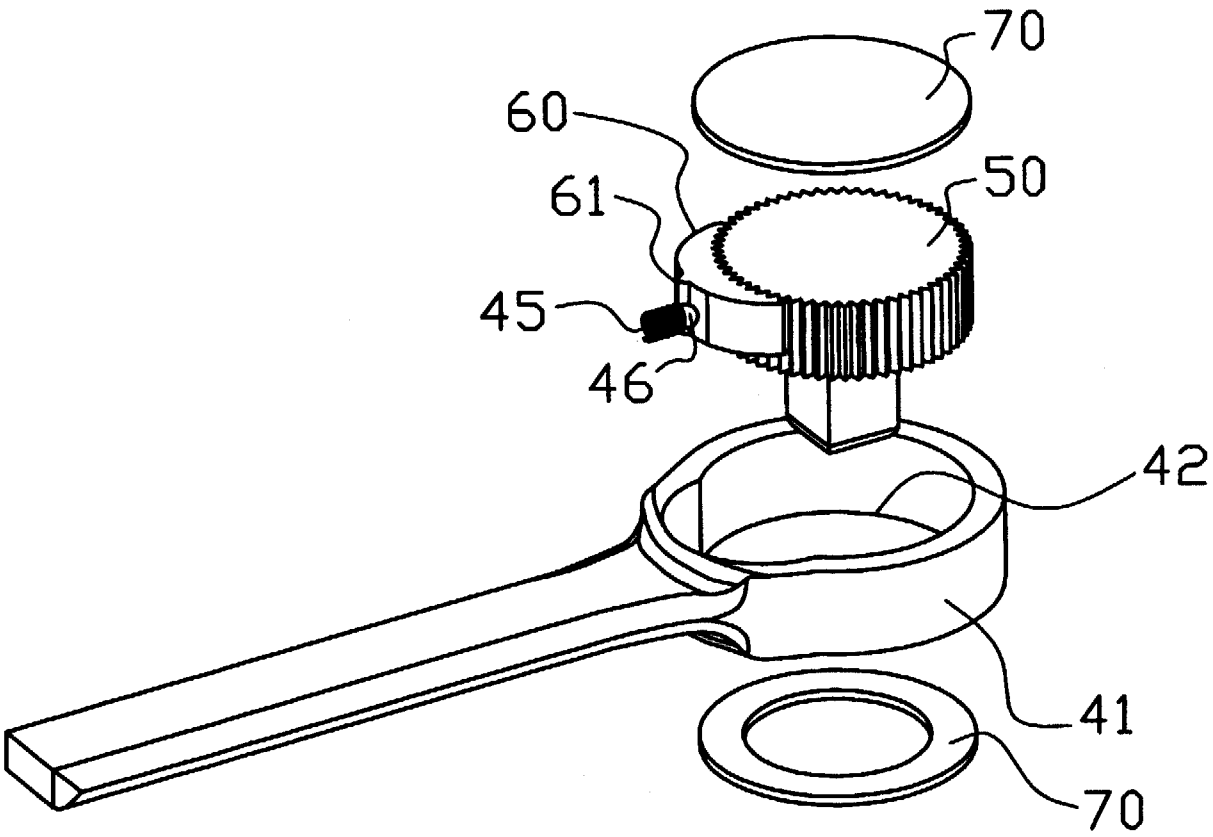
FIG. 24 is a perspective view of the ratchet wrench of the present invention.

Referring to FIGS. 19 and 20, the steel ball 46 can be designed into a semi spherical shape to urge the restrictive teeth structure 60, which also can achieve the change of direction of rotation.

In accordance with the present invention, if dual direction of rotation is not required, as shown in FIGS. 21, 22, 23 and 24, the head portion of the ratchet wrench 40 is provided with a circular opening 42 to accommodate the ratchet wheel 50. A cavity 43 is provided to the circular opening 41, adjacent to the rod body of the wrench 10 contain the restrictive teeth structure 60. The end terminal of the cavity 43 is provided with a ball hole 44 to contain the spring 45 and the steel ball 46. The steel ball 46 urges the protruded block 61 of the restrictive teeth structure 60. Thus, the steel ball 46, the spring 45 and the restrictive teeth structure 60, remain no change with respect to their positions. This preferred embodiment can provide a high torque unidirectional wrench.

In operation, the ratchet wheel 50 rotates clockwise to drive the restrictive teeth structure 60. As the restrictive teeth structure 60 is restricted by the wall of the cavity 43, if the exerted force becomes larger and larger, the urging force also becomes larger to produce high torque rotation function. When the ratchet wheel 50 rotates in a counterclockwise direction, the protruded block 61 urges the steel ball 46, and the steel ball 46 is urged by the spring 45. As the spring 45 is compressible, the restrictive teeth 60 is pressed downward to the steel ball 46, and the engagement of the restrictive teeth structure 60 and the ratchet wheel 50 is separated. That is, it is similar to the te e th-skidding phenomena and the ratchet wheel 50 rotates freely. Thus, the wrench is restricted to a single direction of rotation.

Figure 25:
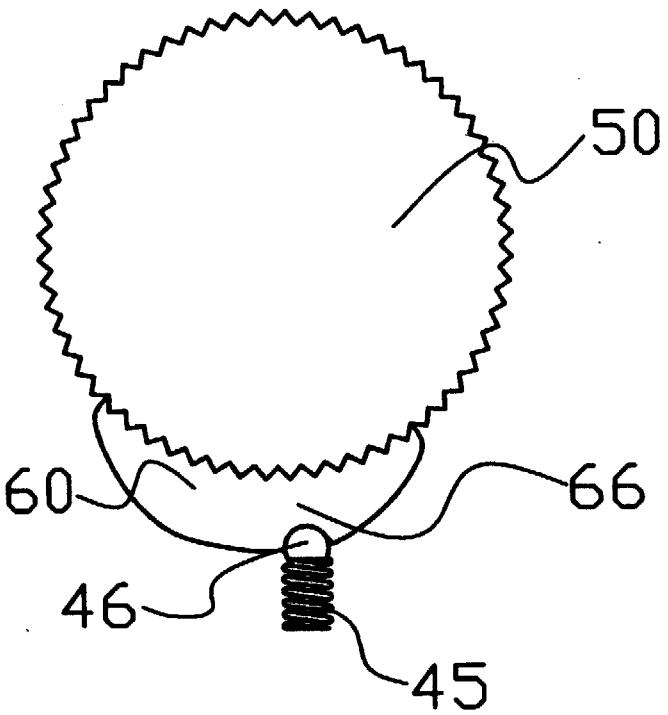
FIGS. 25 and 26 are schematic view of the unidirectional movement of another preferred embodiment of the present invention.

Referring to FIG. 25, a recess portion 66 is provided to the restrictive teeth structure 60 and the steel ball 46 urges the recess portion 66 of the restrictive teeth structure 60. Thus the above function can also be attained.

Figure 26:
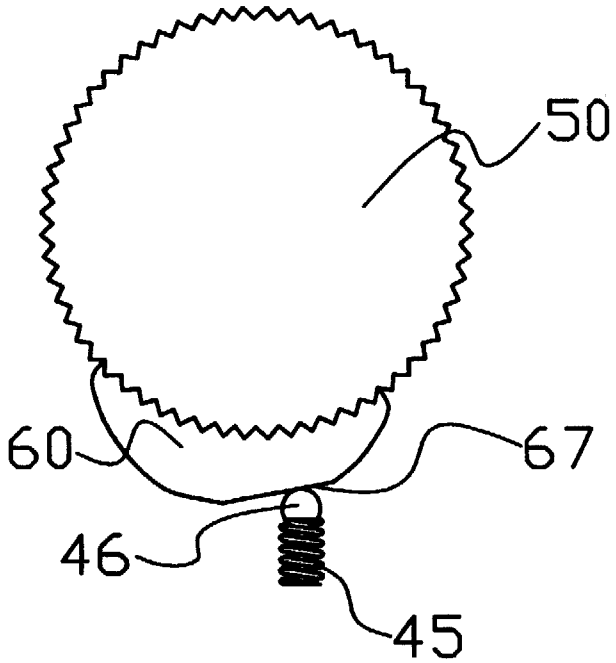

Referring to FIG. 26, an urging end 67 is provided to the restrictive teeth structure 60 and the steel ball 46 urges the urging end 67. Thus, the above function can also be achieved. While the invention has been disclosed and described with reference to preferred embodiments, it will apparent that variations and modifications may be made therein, and it is therefore intended in the following claims to cover each such variation and modification as falls within the true spirit scope of the invention.

I claim:

1. A structure of a ratchet wrench, having a circular opening with a rotating disc, provided at the head of the wrench to contain a ratchet wheel, characterized in that a cavity is provided to the circular opening to contain a restrictive teeth structure, and one end of the cavity is provided with a ball hole for the accommodation of a spring and a steel ball, and the steel ball urges against the restrictive teeth structure, the top end of the ratchet teeth of the ratchet wheel is extended with an extension having a relative small diameter, a circular groove is provided to the extension for the engagement with a fastening ring, the restrictive teeth structure includes a top ratchet teeth and a bottom ratchet teeth, the bottom ratchet teeth corresponding to the ratchet teeth of the ratchet wheel, and the top ratchet teeth correspondingly interlinked with the rotational ratchet teeth of a rotating disc, the rotating disc has an inner ring hole which is provided with a circular groove which is corresponding to the circular groove of the ratchet wheel for the mounting of the fastening ring, the end face of the rotating disc is provided with an embossed surface and the bottom surface of the embossed surface is provided with a rotational ratchet wheel which is corresponding to the ratchet wheel of the restrictive teeth structure to drive the restrictive teeth structure.

2. The structure of a ratchet wrench as set forth in claim 1, wherein the side surface of the rotating disc is extended to an interlinking block to trigger the restrictive teeth structure to rotate.

3. The structure of a ratchet wrench as set forth in claim 1, wherein the top face of the restrictive teeth structure is provided with a depression hole, and the top end of the cavity is provided with a slot, the extension rod of a push button passes through the slot and is mounted into the depression of the restrictive teeth structure, the pressing of the push button directly moves the restrictive teeth structure to provide a rotation.

* * * * *